United States Patent [19]

Larson et al.

[11] 4,042,743

[45] Aug. 16, 1977

[54] COMPRESSIBLE OFFSET PRINTING BLANKET

[75] Inventors: Charles E. Larson, Attleboro, Mass.

[73] Assignee: Uniroyal, Inc., New York, N.Y.

[21] Appl. No.: 654,190

[22] Filed: Feb. 2, 1976

Related U.S. Application Data

[63] Continuation of Ser. No. 45,469, June 11, 1970, abandoned.

[51] Int. Cl.[2] ..... B41N 9/00

[52] U.S. Cl. ..... 428/306; 428/320; 428/327; 428/909

[58] Field of Search ..... 428/320, 306, 310, 322, 428/323, 325, 909, 311, 327; 260/2.5 B

[56] References Cited

U.S. PATENT DOCUMENTS

| | | | |
|---|---|---|---|
| 2,099,024 | 11/1937 | Lewis | 428/909 |
| 3,046,172 | 7/1962 | Reid | 428/308 |
| 3,285,799 | 11/1966 | Peterson | 428/909 |
| 3,597,297 | 8/1971 | Buchholtz et al. | 428/17 |
| 3,676,282 | 7/1972 | Volmer | 428/909 |
| 3,887,750 | 6/1976 | Duckelt et al. | 428/909 |
| 3,983,287 | 9/1976 | Goossen et al. | 428/909 |

*Primary Examiner*—James J. Bell

*Attorney, Agent, or Firm*—Hubbell, Cohen, Stiefel & Gross

[57] ABSTRACT

A compressible offset printing blanket comprising a compressible cellular elastomeric layer or layers which contain resin microballoons in an elastomeric material. Preferably the compressible cellular elastomeric layer(s) is deposited from a layer of a cement of the uncured elastomer with which the resin microballoons have been admixed.

7 Claims, 2 Drawing Figures

INVENTORS
R. T. NOJIRI
C. E. LARSON
BY
Robert J. Patterson
ATTORNEY

INVENTORS
R. T. NOJIRI
C. E. LARSON
BY
Robert J. Patterson
ATTORNEY

COMPRESSIBLE OFFSET PRINTING BLANKET

This is a continuation, of application Ser. No. 45,469, filed June 11, 1970 now abandoned.

BACKGROUND OF THE INVENTION

1. Field of the Invention

The field of the invention is compressible offset printing blankets, that is, blankets which are compressible in use and which are particularly suited for use in offset printing. Such blankets must be so constructed as to undergo repeated compression and rapid recovery during printing and have a long life so that long runs without shutdown are possible.

2. Description of the Prior Art

Conventional offset printing blankets are now made with a multi-ply fabric base and a vulcanized elastomeric face. Compressible blankets consist of a multi-ply fabric base with a cellular compressible layer or layers buried somewhere in the base and a vulcanized elastomeric face. The majority of such compressible blankets comprise a single compressible layer, but some are made with two compressible layers. The compressible layer may be a spongy elastomeric material deposited from a cement of an elastomeric polymer which is made spongy in various ways, as by beating air into the cement, laying down a layer of the frothed or foamy cement on the fabric carcass which may already have been vulcanized, followed by removal of the volatile organic solvent content of the cement, and completion of the blanket, as by application of a woven fabric sheet followed by laying down a solid elastomeric facing layer made from a rubbery polymer capable of withstanding the solvent action of the ink used in the printing process and by vulcanization of the unvulcanized elastomeric components of the blanket in a conventional vulcanizing unit.

Another way of obtaining the compressible layer is described in U.S. Pat. No. 3,147,698 issued in the name of William C. Ross and assigned to W. R. Grace & Co. This patent is directed to making the compressible material by impregnating a highly porous felted fibrous web with an elastomeric material in solution or water dispersion, typically natural rubber latex, followed by vulcanization, to produce a sheet having certain specific characteristics of firmness and porosity.

SUMMARY OF THE INVENTION

This invention is based on the unexpected and unobvious discovery that compressible offset printing blankets having the requisite performance characteristics and compressibility can be made by simply incorporating resin microballoons in suitable proportions in the compressible elastomeric layer or layers of the blankets. Stated in another way, the invention resides in the discovery that the incorporation of such microballoons imparts to the elastomeric layer, by some mechanism not yet fully understood, a fine-celled structure having the right proportion of both open and closed cells with the result that printing blankets embodying such a cellular elastomeric layer have outstanding properties for use in offset printing.

Preferably the blanket embodies a conventional backing below the cellular compressible layer. This backing typically comprises a plurality of woven fabric layers of low extensibility in the warp direction, i.e., in the longitudinal direction of the blanket when in service. The reason for having low stretch in this direction is that it is highly desirable to avoid stretch when the blanket is put on the cylinder and tightened up for printing. If the blanket continues to stretch, it grows as it is used and this requires stopping the press to tighten the blanket before continuing the printing. Typically these fabric layers are bonded to one another with any suitable adhesive to form the backing which commonly has a thickness of from 0.020 to 0.040 inches. If desired this backing may be vulcanized before applying the compressible layer and the vulcanizable elastomeric face.

The blanket of our invention preferably also embodies a layer of fine (thin and smooth) woven fabric bonded to the upper face of the compressible cellular layer and having a thickness ranging from 0.003 to 0.012 inches.

We believe that the novel feature of the blanket of the invention is the cellular compressible layer. It will be understood that in the typical practice of the invention the several layers making up the blanket are bonded to one another in any suitable manner, as by use of an adhesive, to form a unitary structure.

The invention is an offset printing blanket comprising at least one compressible cellular elastomeric layer containing resin microballoons which impart the desired cellularity and compressibility to the blanket.

DESCRIPTION OF THE PREFERRED EMBODIMENT

Figure 1:
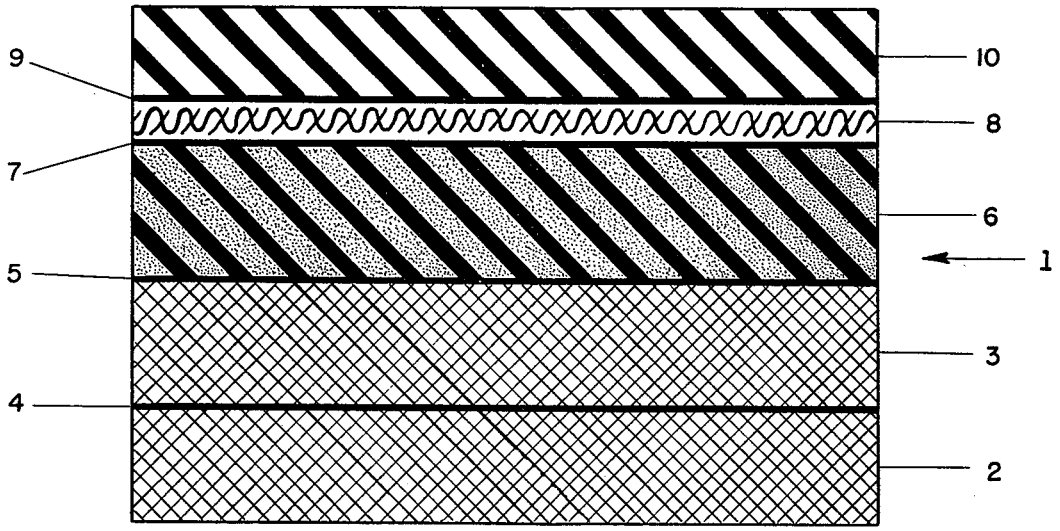
FIG. 1 portrays in section, greatly enlarged, a printing blanket of the invention.

In FIG. 1 of the drawings, the blanket 1 embodies a backing made by adhesively plying together woven fabric layers 2 and 3 with adhesive layer 4 which can be laid down from rubber cement. Layers 2 and 3 are preferably made of fine plain woven fabric of lower extensibility in the warp direction (in the longitudinal or machine of the blanket in service), typically made from high grade cotton yarn, free from slubs and knots, weaving defects, seeds, etc. and typified by a cotton fabric of the type conventionally used as a backing fabric in printing blankets.

The specifications for a cotton fabric suitable for use as layers 2 and 3 are as follows:

| Properties | Min. | Std. | Max. |
|---|---|---|---|
| Width | As ordered | | |
| Weight-Oz./Sq.Yd. | 5.62 | 5.80 | 5.98 |
| Ends/Inch | 52 | 54 | 56 |
| Picks/Inch | 56 | 58 | 60 |
| Yarn Size and Ply Warp | 20/2 | Combed Egyptian Minimum skein break of 375# | |
| Yarn Size and Ply Filling | 21/1 | Combed Peeler | |
| Weave | — | Plain | |
| Selvedge | — | Rice or D | |
| Length of Piece (yards) (unstretched) | 400 | 405 | 410 |
| Tensile-Warp-Grab | 133# | 140# | — |
| Tensile-Filling-Grab | 80.0# | 85.0# | — |
| Gauge-Inches | .015 | .016 | .017 |
| L.T.F. (Lithographic Technical Foundation) Residual Stretch | — | — | 2.0% |

The description of the LTF test is as follows:

-continued

| Properties | Min. | Std. | Max. |
|---|---|---|---|
| Cut 1" × 12" samples, 12" in the warp direction. Mark 1" × 10" (i.e., 1" in from each end). Hang 50 lb. weight on one end of sample for 1 hour. Measure distance (x) between marks after 1 hour with weight on. | | | |
| % LTF stretch $= \frac{x - 10}{10} \times 100$ | | | |
| % temporary = after 1 hour with weight on. | | | |
| % residual = 5 minutes after weight removed. | | | |

The fabric described above is given as a typical example. The important point is that a fabric combination be chosen to give a finished blanket having an LTF residual stretch of approximately 2% or less. This is done to avoid having to stop a printing press to tighten up the blanket during operation.

The backing optionally may be vulcanized prior to the following steps in the manufacture of the finished blanket.

On the upper face of the backing is another layer 5 of the adhesive. Superimposed on the resulting assembly is compressible layer 6 which is laid down from a cement of a compounded elastomeric material in a volatile organic solvent admixed with resin microballoons typically in amount ranging from 15 to 50 parts per 100 parts of elastomer in the cement. The mixture from which layer 6 is formed typically has the following formulation:

| Ingredient | Parts by Weight |
|---|---|
| Neoprene GRT (Polychloroprene, a synthetic elastomer made by E. I. du Pont) | 100 |
| "Amberex SR" (trademark) (a factice vulcanized vegetable oil type extender made by Stamford Rubber Supply) | 20 |
| Light Magnesium Oxide | 4 |
| Stearic Acid | 3 |
| "Aminox" (trademark) (an antioxidant made by Uniroyal, Inc. by low temp. reaction of acetone and diphenylamine. | 1 |
| SRF Carbon Black Pellets | 10 |
| Petrolatum | 4 |
| Aromatic Petroleum Hydrocarbon Oil (extending oil) | 20 |
| Zinc Oxide | 5 |
| Phenolic Resin Microballoons (resinous microballoons made by Union Carbide) | 30 |
| "NA-22" (trademark) (an accelerator, ethylene urea, made by E. I. du Pont) | 1 |
| Toluol | 210 |

All of the above-listed ingredients, except the microballoons, are compounded in a manner obvious to those skilled in the art to form a cement of the compounded elastomeric material containing all of the compounding and vulcanizing agents required to yield a vulcanizate having the requisite properties. The microballoons are then incorporated with this cement in such a way (as by gentle stirring) as to avoid any appreciable crushing of the microballoons. By varying the amount of toluol used the solids level of the resulting mixture can be varied say from 45% to 55% by weight and its viscosity can be varied say from 90,000 to 170,000 centipoises. The mechanism by which the incorporation of the microballoons imparts the desired combination open-celled and closed-cell structure to the compressible layer of the blanket is not fully understood at present. However, it is thought that it may well be that the microballoons carry entrained air into the cement and that such air is held in the final vulcanized cellular layer in such a way as to impart a desirable combined open-celled (intercommunicating) structure and closed-cell (unicellular) structure resulting from the gas bubbles attached to and within the microballoons themselves. To this end it is preferable that the incorporation of the microballoons with the cement be accomplished in such a way as to favor such air entraining action.

The invention is not limited to phenolic (phenolformaldehyde) resin microballoons but can be practiced with microballoons made from any resin which is not soluble in the solvent used in the cement and which is not subject to heat softening at the temperatures required to vulcanize the blanket. Examples of other microballoons are those made from urea-formaldehyde and melamine-formaldehyde resins. Preferably the resin of which the microballoons are made is a thermoset phenoplast or aminoplast resin. Mixtures of different kinds of resin microballoons can be used, if desired, an example being a mixture of phenolic resin microballoons and polyvinylidene chloride ("Saran" (trademark)) microballoons. Any of the resins mentioned in U.S. Pat. No. 2,797,201 as useful for making microballoons for use in low density articles can be employed subject to the foregoing qualifications.

The invention is not limited to the use of neoprene as the elastomer in the compressible cellular layer 6. Any suitable polymeric material which is considered a curable or vulcanizable elastomeric material can be employed. Examples are natural rubber, SBR styrene-butadiene rubber, EPDM (ethylene, propylene, non-conjugated diene terpolymer rubber), butyl rubber, neoprene, NBR (butadiene-acrylonitrile rubber), polyurethanes, etc. Preferably the polymer should be a material which can be vulcanized so as to become adequately resistant to heat and to the printing inks used in the printing processes employed. Particularly suitable are such oil-resistant rubbers as neoprene and NBR. Resistance to the solvents used in the inks is desirable even though the cellular layer or layers are buried within the blanket, because in use the inks often contact the edges of the blanket and would cause undesired swelling and softening if the elastomer in the cellular layer were not solvent-resistant.

The above formulation is spread over the surface of the backing in any suitable way as by means of a knife over roll spreader, the blade being raised while spreading in the obvious way to give a smooth compressible layer 6 after vulcanization. The bulk of the solvent is evaporated from cellular layer 6 after it has been laid down.

A layer 7 of the adhesive is then applied over layer 6 whereupon a fabric sheet 8 is applied smoothly over adhesive layer 7. Sheet 8 is preferably a very high quality plain woven fabric which is free from slubs or other surface imperfections. It may be made from cotton, rayon, nylon, or polyester. It may even be of the non-woven type. Typically it is 0.003–0.012 inch thick.

Preferably fabric layer 8 is considerably thinner than the fabric used as layers 2 and 3 to form the backing. An example of a fabric suitable for layer 8 is a plain woven cotton cambric which is free from slubs, knots, weaving defects, seeds, etc., has been scoured and mercerized in manufacture, and has the following specifications:

| | |
|---|---|
| Weight per square yard | 2.64 ounces |
| Threads per inch (warp) | 127 |
| Threads per inch (weft) | 120 |
| Gauge | 0.0055" |
| Tensile strength (warpwise) | 75 lbs./in. |

-continued

| | |
|---|---|
| Tensile strength (weftwise) | 50 lbs./in. |

After application of another layer 9 of adhesive on the upper face of fabric sheeting 8, a layer 10 of solid elastomeric face compound of the kind conventionally used for the face of printing blankets is applied in any obvious manner as by calendering or spreading from cement in the well-known manner. The composite structure is then cured in a vulcanizer in the conventional manner to give the final blanket which is ready for use.

The entire sequence of steps used in making the blanket is carried out in such a way that substantial crushing of the microballoons is avoided prior to the final stages of vulcanization at which point in time the strength of the vulcanizate is great enough to retain the advantageous cellular structure of the compressible layer despite application of force sufficient to cause some crushing of such microballoons.

Figure 2:
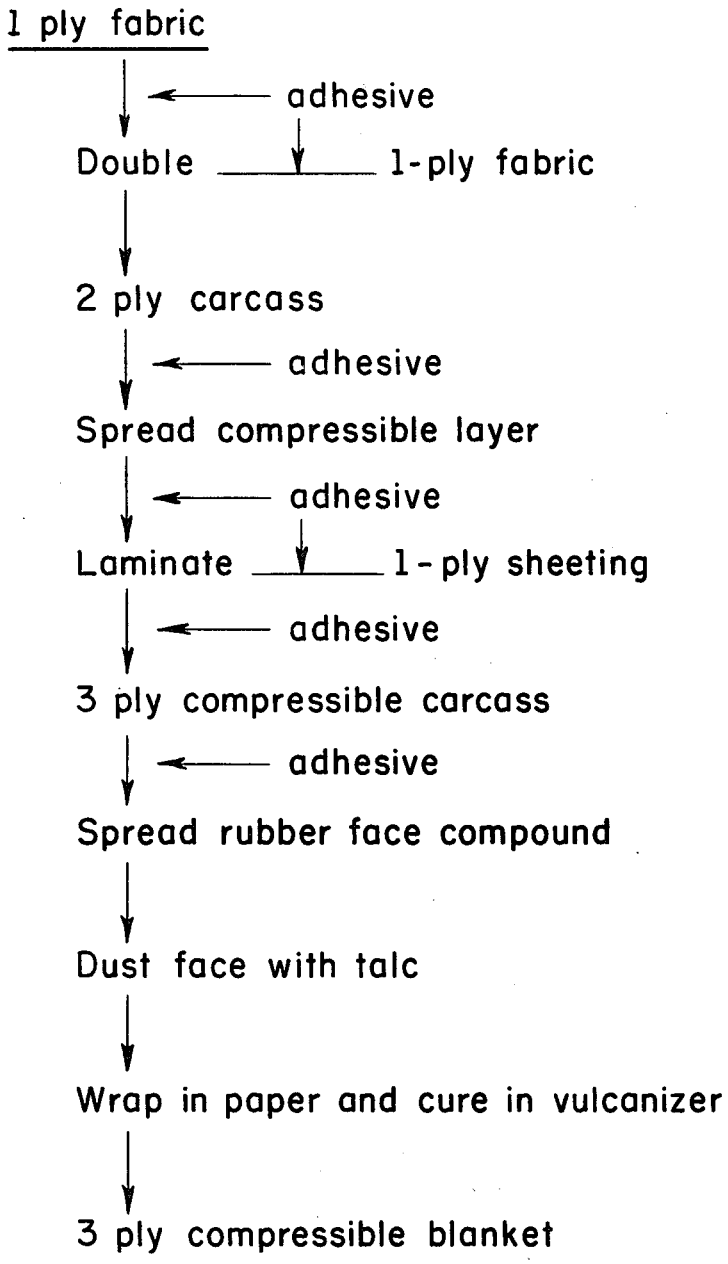
FIG. 2 shows diagrammatically a typical sequence of steps used in making such a blanket.

FIG. 2 portrays diagrammatically a typical sequence of steps used in making blankets according to the invention.

While the thicknesses, order, and kinds of layers used in the blanket can vary somewhat, a typical example is as follows:

| Reference Numeral | Kind of Layer | Approximate Thickness in Inches |
|---|---|---|
| 2 | Base fabric | 0.013 |
| 3 | Base fabric | 0.013 |
| 6 | Cellular layer | 0.017 |
| 8 | Fine cotton sheeting | 0.006 |
| 10 | Rubber face | 0.013 |
| 4, 5, 7, 9 | Bonding cement | 0.004 |
| | Total | 0.066 |

The invention is not limited to the use of a single compressible cellular layer 6 buried in the body of the blanket. Two or more such compressible layers can be employed, if desired. The thickness of cellular layer 6 can be varied quite widely. Typically its thickness ranges from 0.015 inch to 0.020 inch.

Blankets made according to the invention can be used as offset blankets in fine half-tone lithography. They give fine half-tone dot reproduction, low plate-to-blanket pressure, long plate life, excellent smash resistance, each make ready, and easy fine adjustment of the press for printing. The invention also enables easy preparation of the blankets and accurate control of the characteristics of the compressible layer or layers which must be used in compressible printing blankets.

Instead of using the blanket structure of the present invention directly as a compressible offset blanket itself, under certain conditions it can advantageously be used as the bottom sheet of a two-piece blanket.

From the foregoing it will be seen that the use of resin microballoons in accordance with the present invention provides a compressible printing blanket which is simple to manufacture and extremely effective in use. The invention is unobvious because it could not have been foreseen that a highly satisfactory compressible blanket could be obtained by the inclusion of resin microballoons in an elastomeric layer. Blankets in widths up to 79 inches made according to the invention have been very successfully used under actual offset printing conditions.

The invention is to be taken as limited only as set forth in the accompanying claims.

Having thus described our invention, what we claim and desire to protect by Letters Patent is:

1. A laminated printers' blanket comprising a layer having a printing surface, at least one strengthening layer, and a compressible layer of a cellular resilient polymer between the layer having the printing surface and the strengthening layer, the cells of the cellular resilient polymer including resinous hollow microspheres in the polymer matrix, each surface of said compressible layer having a substantially planar surface when said blanket is in a flat position.

2. A printers' blanket according to claim 1 in which the microspheres are frangible microspheres.

3. A printers' blanket according to claim 1 in which the polymer is selected from the group consisting of polychloroprene and nitrile rubber.

4. A printers' blanket according to claim 1 which comprises a plurality of strengthening layers.

5. A printers' blanket according to claim 1 which additionally comprises a thin layer of textile fabric between the compressible layer and the layer having the printing surface, which thin layer is in the form of an elastomeric veneer.

6. A printers' blanket according to claim 1 in which the microspheres are of a material selected from the group consisting of an organic thermoplastic material and phenolic resin.

7. The printers' blanket according to claim 5 wherein said thin layer has a thickness in the range of 0.125 to 0.25 mm.

* * * * *

UNITED STATES PATENT OFFICE

CERTIFICATE OF CORRECTION

Patent No. 4,042,743 Dated August 16, 1977

Inventor(s) Charles E. Larson

It is certified that error appears in the above-identified patent and that said Letters Patent are hereby corrected as shown below:

In the drawings, at the bottom of Figs. 1 and 2, Inventor "R. J. Nojiri" should be deleted.

Column 2, line 39, "lower" should read--low--; line 40, after "chine" insert -- direction --.

Column 4, lines 28 and 29, "SBR, styrene-butadiene rubber" should read -- SBR (styrene-butadiene rubber), --.

Signed and Sealed this

*Twenty-seventh* Day of *December 1977*

[SEAL]

*Attest:*

RUTH C. MASON
*Attesting Officer*

LUTRELLE F. PARKER
*Acting Commissioner of Patents and Trademarks*